United States Patent [19]

Wood

[11] Patent Number: 4,839,662

[45] Date of Patent: Jun. 13, 1989

[54] COMPOSITE WAVEGUIDE COUPLING APERTURE HAVING A VARYING THICKNESS DIMENSION

[75] Inventor: Peter J. Wood, Nepean, Canada

[73] Assignee: Canadian Astronautics Limited, Ontario, Canada

[21] Appl. No.: 279,248

[22] Filed: Dec. 1, 1988

Related U.S. Application Data

[63] Continuation of Ser. No. 819,041, Jan. 15, 1986, abandoned.

[30] Foreign Application Priority Data

Jan. 18, 1985 [CA] Canada ..... 472357

[51] Int. Cl.[4] ..... H01Q 13/10

[52] U.S. Cl. ..... 343/771; 343/767

[58] Field of Search ..... 343/767, 768, 769, 770, 343/771; 333/113, 122

[56] References Cited

U.S. PATENT DOCUMENTS

| | | | |
|---|---|---|---|
| 3,761,937 | 9/1973 | Tricoles et al. | 343/770 |
| 4,328,502 | 5/1982 | Scharp | 343/771 |
| 4,371,877 | 2/1983 | Doussot et al. | 343/770 |
| 4,571,592 | 2/1986 | Justice | 343/767 |
| 4,642,586 | 2/1987 | Fowler | 333/122 |
| 4,644,343 | 2/1987 | Schneider et al. | 343/771 |
| 4,752,781 | 6/1988 | Wood | 343/771 |

FOREIGN PATENT DOCUMENTS

| | | | |
|---|---|---|---|
| 0224901 | 12/1984 | Japan | 333/122 |

*Primary Examiner*—William L. Sikes
*Assistant Examiner*—Doris J. Johnson
*Attorney, Agent, or Firm*—Oliff & Berridge

[57] ABSTRACT

A composite coupling aperture for coupling energy between two waveguides having a thickness dimension t perpendicular to the aperture-plane characterized by a non-uniform cross-section along the thickness dimension.

9 Claims, 2 Drawing Sheets

COMPOSITE WAVEGUIDE COUPLING APERTURE HAVING A VARYING THICKNESS DIMENSION

This is a Continuation of application Ser. No. 06/819,041 filed Jan. 15, 1986 now abandoned.

CROSS-REFERENCE TO RELATED APPLICATION

This application is related to concurrently filed, commonly assigned application by the same inventor entitled SIDE-LOOKING AIRBORNE RADAR (SLAR) ANTENNA which is incorporated herein by reference.

FIELD OF THE INVENTION

The present invention relates to the coupling of electro-magnetic energy in general and in particular to coupling apertures or slots between waveguides. More particularly still, it relates to coupling apertures that have, in addition to dimensions in the slot-plane, a significant dimension (depth) perpendicular to the slot-plane. More particularly yet, the present invention provides a novel coupling aperture or slot which has a variable cross-sectional area along the coupling path.

BACKGROUND OF THE INVENTION

Co-pending, concurrently filed patent application Ser. No. 819,037, now U.S. Pat. No. 4,752,781 entitled "Side-Looking Airborne Radar (SLAR) Antenna" by the same inventor discloses a radar antenna array which, for mechanical reasons, required coupling between two waveguides separated by a 0.4 inch thick wall and a range of coupling of between −31 dB and −14 dB. But again for mechanical reasons, it was not possible to realize the degree of coupling by the prior art methods of displacing the coupling slot closer to or farther away from the centre line of the wall of the power feeding waveguide. A new composite coupling aperture (conduit actually) was devised to adjust the degree of coupling while accommodating the necessary mechanical constraints.

SUMMARY OF THE INVENTION

The present invention provides a composite coupling aperture or slot having at least three significant dimensions, instead of the two of conventional coupling slots. These dimensions are length l, width w and thickness t.

In its broader aspect, the composite coupling aperture is characterized by having non-uniform cross-sectional areas along its thickness dimension t.

In a narrower aspect, the cross-sectional area changes abruptly between the opposite, waveguide coupled ends of the aperture.

Due to the complexity of the composite coupling aperture, it is possible to synthesize such apertures only by a combination of calculation and experimentation.

BRIEF DESCRIPTION OF THE DRAWINGS

The preferred embodiment of the present invention will now be described in conjunction with the annexed drawings, in which.

DETAILED DESCRIPTION OF THE PREFERRED EMBODIMENT

In order to provide a better understanding of the design procedure for the preferred embodiment, it is useful to begin with a theoretical treatment of a simple non-composite, thick-wall coupling aperture or slot.

Figure 1:
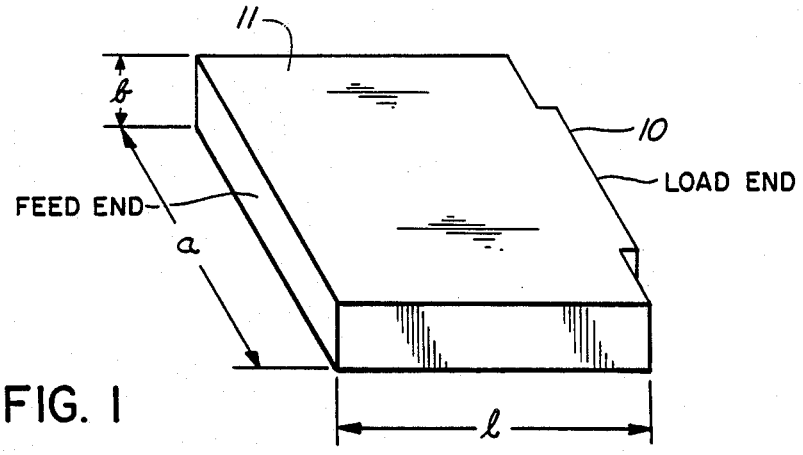
FIG. 1 depicts a thick-wall coupling aperture model helpful in understanding the theory of the present invention.

With reference to FIG. 1 of the drawings, a thick-wall slot may be regarded as a conventional slot 10 terminating a rectangular coupling waveguide 11. The waveguide 11 as illustrated in the figure has a cross-section of (a×b) and a length l. The characteristic impedance of a rectangular waveguide may be defined in various ways. For the present purposes, it is convenient to imagine the slot as being driven by a voltage source connected across its centre (this configuration being compatible with the usual text book definition of the admittance of a slot radiating from a ground plane). It is then assumed that the central drive point current would be equal to the total current flowing through either of the broad faces of the rectangular coupling waveguide. From a different point of view, this hypotheses is equivalent to assuming that the shunt susceptance loading corresponding to the discontinuity at the slot end of the coupling waveguide may safely be neglected.

On the basis postulated above, the relevant definition of coupling waveguide inpedance may be described as 'mid-section voltage÷total broad face current'. Thus, according to R. J. Collin's 'Field of Guided Waves', the coupling waveguide characteristic impedance is $$Z_o = \frac{k}{\beta} \; \frac{\pi b}{2a} \times 377\ \Omega \tag{1}$$

where
$k = 2\pi/\lambda$
$\beta = 2\pi/\lambda_g$ and $\lambda$ and $\lambda_g$ are the wavelengths for free space, and in the coupling waveguide 11, respectively.

The terminating impedance $Z_s$ represented by the slot may be derived by applying considerations of Babinet's duality to the corresponding flat dipole (see C. Balanis, "Antenna Theory, Analysis, and Design", pp. 497–8) and is given by $$Z_s = (377\Omega)^2/(4Z_d), \tag{2}$$

where $Z_d$ is the dipole impedance.

We now define a dimensionless parameter $\delta$ according to $$\delta = kl \frac{\pi b}{2a} \; \frac{(377\ \Omega)}{Z_s} \tag{3}$$

The reflection coefficient $\rho$ in the coupling waveguide is given by conventional transmission line theory (e.g. see Balanis, above) as $$\rho = \frac{Z_s - Z_o}{Z_s + Z_o} \quad (4)$$

and the input impedance at the driven end of the coupling waveguide is similarly given by $$\frac{Z_{in}}{Z_o} = \frac{1 - \rho^2 - 2j\,\rho\sin(2\theta)}{1 + \rho^2 + 2\rho\cos(2\theta)}, \quad (5)$$

where $$\theta = \beta l \quad (6)$$

The ratio of voltage signals at either end of the waveguide is given (again by transmission line theory) as $$t_w = \frac{1 + \rho}{\exp(j\theta) + \rho\exp(-j\theta)} \quad (7)$$

Since $Z_{in}$ represents effectivrely a series connected element in the equivalent transmission line corresponding to a feeder waveguide, the overall transfer coefficient is given by $$t = t_w \frac{Z_{in}}{Z_{eff}} \quad (8)$$

where $Z_{eff}$ is an effective characteristic impedance of the feeder waveguide which takes into account the location of the slot aperture on the broad face. The overall voltage transfer coefficient is then represented by the equation $$t\frac{Z_{eff}}{Z_o} = (1 + \rho)\exp(-j\theta)\frac{(1 - \rho\cos(2\theta) \cdot j\rho\sin(2\theta)}{(1 + \rho^2 - 2\rho\cos(2\theta)}$$

As an example, the following Tables I and II show theoretically computed values of $Z_{in}$ as a function of $\theta$, and $tZ_{eff}/Z_o$ as a function of $2a/\lambda$, respectively.

TABLE 1

| Calculated Impedance at Input of Coupling Guide | | |
|---|---|---|
| IMAGINARY PART OF PROPAGATION COEFFICIENT FOR COUPLING GUIDE $\theta$ RADIANS | INDEPENDANCE AT DRIVEN END OF COUPLING GUIDE OHMS Z in | |
| | REAL PART | IMAGINARY PART |
| 0 | 1946 | 214 |
| 0.05 | 1950 | 170 |
| 0.1 | 1950 | 36 |
| 0.15 | 1909 | −178 |
| 0.2 | 1783 | −440 |
| 0.3 | 1245 | −830 |
| 0.5 | 340 | −590 |

TABLE II

| Voltage Transfer Coefficient for Thick-Wall Slot | |
|---|---|
| COUPLING WAVEGUIDE H PLANE DIMENSION PARAMETER $2a/\lambda$ | OVERALL VOLTAGE TRANSFER COEFFICIENT, RELATIVE TO RESONANT THIN WALLED SLOT CASE |
| 1.0 | $1.0 < -0°$ |
| 1.005 | $0.994 < -11°$ |
| 1.01 | $0.955 < -21°$ |
| 1.05 | $0.517 < -62°$ |
| 1.1 | $0.312 < -75°$ |

TABLE II-continued

| Voltage Transfer Coefficient for Thick-Wall Slot | |
|---|---|
| COUPLING WAVEGUIDE H PLANE DIMENSION PARAMETER $2a/\lambda$ | OVERALL VOLTAGE TRANSFER COEFFICIENT, RELATIVE TO RESONANT THIN WALLED SLOT CASE |
| 1.15 | $0.232 < -80°$ |
| 1.3 | $0.149 < -85°$ |
| 1.5 | $0.116 < -87°$ |

Both Tables I and II correspond to a case specified by the geometrical parameters b=0.16" (coupling waveguide E-plane dimension)

l=0.4" (coupling waveguide length)

f=9200 Mhz, and a=0.65" (coupling waveguide H-plane dimension) (assumed for Table I)

The tables also assume that the slot itself has an impedance of 1946 ohms when driven at its centre, corresponding to a resonant slot length.

From the data presented in Tables I and II, it may be seen that provided the 'a' dimension of the feeder waveguide approaches the free space half-wave, the overall effective coupling level is very similar to that for a conventional thin wall slot. The bandwidth for the thick-wall design is, however, smaller. Also the phase angle of the voltage-transfer coefficient increases rapidly with 'a', when 'a' is in the vicinity of $\lambda/2$ (maximum coupling case).

The basic theory as described above may be extended to the case of a composite coupling made up of two waveguides of different cross-sections, by applying transmission line principles. It is found that electrically such a composite structure behaves much as a single thick slot whose 'a' and 'b' dimensions are approximately given by the arithmetic mean of the 'a' and 'b' dimensions of the two parts of the composite aperture.

Figure 2:
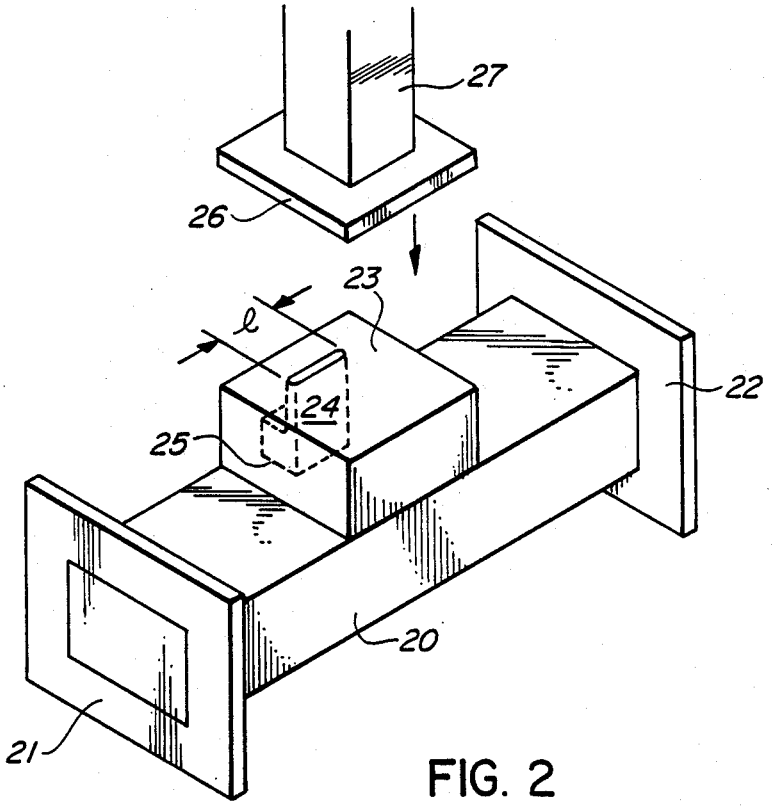
FIG. 2 depicts a test jig for experimental determination of design parameters of a composite coupling aperture according to the present invention.

With reference now to FIG. 2, the practical design steps are as follows for a composite coupling aperture:

(1) Calculate the H-plane feeder waveguide width required for the particular application. In the case of the preferred embodiment shown in FIG. 3 for a SLAR antenna as disclosed in the said copending, concurrently filed application, the feeder waveguide width would be that necessary to realize the desired beam angle in the azimuth-plane. Such calculation is a standard calculation and may follow Johnson and Jasik's "Antenna Engineering Handbook" (1984, McGraw-Hill).

(2) Derive the (conventional) slot coupling coefficients required as per the principles given in Johnson and Jasik, supra. Again for the preferred embodiment the coefficients would be those necessary to realize the azimuth array excitations.

(3) Using the theoretical treatment outlined hereinabove estimate the slot offset distance off the centre line of the feeder waveguide that is necessary to achieve the highest coupling coefficient required. This highest coupling coefficient is to be realized at approximately 6 dB below the peak of the slot resonance curve. This slot offset distance is to be used for all coupling apertures.

(4) Select suitable aperture widths for each of the two cross-sections of the composite aperture according to the mechanical constraints. In the case of the preferred embodiment, that means the widths chosen must (a) be sufficiently wide to allow accurate milling, (i.e. such that the deflection of a milling cutter is insignificant); and (b) constrain the narrow aperture to lie within the end wall of the coupled-to (radiating) waveguide. At the same time the narrow aperture must not conflict with other mechanical requirements such as fastening screws, e.g. of the back-plane cover of the SLAR array. This latter consideration did dictate the minimum thickness (depth) of the narrow aperture (a non-critical dimension). Of course, the thickness of the narrow and wide apertures add up to the total wall thickness between the two waveguides.

(5) No the test jig shown in FIG. 2 must be fabricated. It comprises a waveguide piece 20, with connecting flanges 21 and 22 at eigher end, which has the same dimensions as the feeder waveguide. A metal block 23, which has a composite aperture 24 as determined in step (4) above, closes an aperture in the feeder waveguide 20 with the wide end 25 of the composite aperture 24 opon onto the inside of the waveguide 20. When the composite aperture is being tested, flange 26 of a coupled-to waveguide 27 is connected to the upper surface of the block 23. Of course, at its other end the waveguide 27 must be properly loaded. Now using a microwave network analyzer (not shown) estimate the insertion loss and phase from the waveguide 20 to the waveguide 27. By constructing several such test jigs with different composite slot lengths l, coupling coefficient and insertion phase may be graphed as a function of the length l.

(6) Now the lengths l of the composite aperture corresponding to the requisite coupling coefficients determined in step (2) hereof may be read off the graph constructed under (5). The corresponding uncompensated insertion phases are also read off the graph.

(7) To compensate the insertion phases a longitudinal aperture displacement C (along the length of the feeder waveguide) is calculated as follows $$C = \frac{\text{Insertion Phase in degrees}}{360} \times \lambda_g,$$

where $\lambda_g$ is the wavelength in the feeder waveguide.

Figure 3:
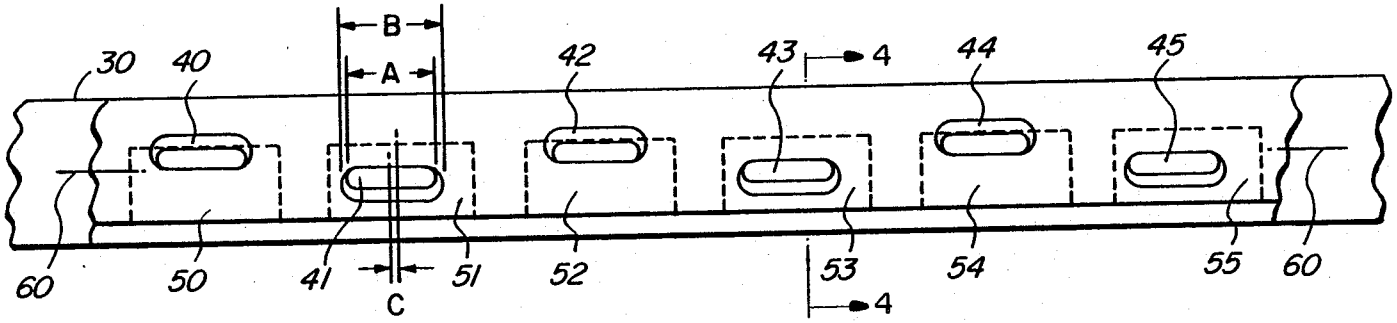
FIg. 3 depicts a series of composite coupling apertures between the broad side of a feeder waveguide and the ends of a corresponding series of radiating waveguides in an antenna array as seen from inside the feeder waveguide.
Figure 4:
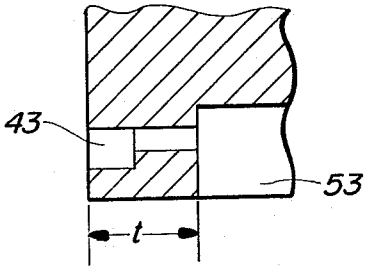
FIG. 4 is a cross-sectional view of the antenna array shown in FIG. 3 taken along the line 4—4.

Referring now to FIG. 3 the application of the above principles to design and construct 187 composite coupling apertures coupling a feeder waveguide 30 to 187 radiating waveguides is explained. In FIG. 3 only six coupling apertures 40, 41, 42, 43, 44 and 45 are shown, coupling the feeder waveguide 30 to associated radiating waveguides 50, 51, 52, 53, 54 and 55. As is apparent in the figure, the coupling apertures 40 to 45 are displaced with respect to the waveguides 50 to 55 along longitudinal axis 60, reflecting by way of illustration only, the insertion phase compensation displacement C referred to in step (7) hereinabove. The other composite aperture dimensions A and B are also shown at the aperture 41. The following pages give the dimensions A, B and C for the 187 composite coupling apertures designed within the context of the preferred embodiment of the said copending, concurrently filed application by the same inventor. Following the table a qualitative explanation of the design considerations is given.

| SLOT NO. | "A" DIM | "B" DIM | "C" DIM |
|---|---|---|---|
| 1 | 0.480 | 0.558 | +0.083 |
| 2 | 0.480 | 0.558 | +0.083 |

-continued

| SLOT NO. | "A" DIM | "B" DIM | "C" DIM |
|---|---|---|---|
| 3 | 0.481 | 0.559 | +0.083 |
| 4 | 0.481 | 0.559 | +0.083 |
| 5 | 0.481 | 0.559 | +0.083 |
| 6 | 0.482 | 0.560 | +0.083 |
| 7 | 0.482 | 0.560 | +0.083 |
| 8 | 0.483 | 0.561 | +0.083 |
| 9 | 0.483 | 0.561 | +0.083 |
| 10 | 0.484 | 0.562 | +0.083 |
| 11 | 0.085 | 0.563 | +0.083 |
| 12 | 0.486 | 0.564 | +0.083 |
| 13 | 0.487 | 0.565 | +0.083 |
| 14 | 0.488 | 0.566 | +0.083 |
| 15 | 0.489 | 0.567 | +0.083 |
| 16 | 0.490 | 0.568 | +0.083 |
| 17 | 0.491 | 0.569 | +0.083 |
| 18 | 0.493 | 0.571 | +0.083 |
| 19 | 0.494 | 0.572 | +0.083 |
| 20 | 0.496 | 0.574 | +0.082 |
| 21 | 0.497 | 0.575 | +0.082 |
| 22 | 0.499 | 0.577 | +0.082 |
| 23 | 0.501 | 0.579 | +0.082 |
| 24 | 0.502 | 0.580 | +0.082 |
| 25 | 0.504 | 0.582 | +0.082 |
| 26 | 0.506 | 0.584 | +0.082 |
| 27 | 0.508 | 0.586 | +0.082 |
| 28 | 0.510 | 0.588 | +0.081 |
| 29 | 0.512 | 0.590 | +0.081 |
| 30 | 0.514 | 0.592 | +0.081 |
| 31 | 0.516 | 0.594 | +0.081 |
| 32 | 0.517 | 0.595 | +0.080 |
| 33 | 0.519 | 0.597 | +0.080 |
| 34 | 0.521 | 0.599 | +0.080 |
| 35 | 0.523 | 0.601 | +0.080 |
| 36 | 0.525 | 0.603 | +0.079 |
| 37 | 0.527 | 0.605 | +0.079 |
| 38 | 0.528 | 0.606 | +0.079 |
| 39 | 0.530 | 0.608 | +0.078 |
| 40 | 0.531 | 0.609 | +0.078 |
| 41 | 0.533 | 0.611 | +0.078 |
| 42 | 0.534 | 0.612 | +0.077 |
| 43 | 0.535 | 0.613 | +0.077 |
| 44 | 0.535 | 0.613 | +0.076 |
| 45 | 0.536 | 0.614 | +0.076 |
| 46 | 0.536 | 0.614 | +0.075 |
| 47 | 0.537 | 0.615 | +0.075 |
| 48 | 0.538 | 0.616 | +0.074 |
| 49 | 0.539 | 0.617 | +0.074 |
| 50 | 0.541 | 0.619 | +0.073 |
| 51 | 0.542 | 0.620 | +0.073 |
| 52 | 0.543 | 0.621 | +0.072 |
| 53 | 0.544 | 0.622 | +0.072 |
| 54 | 0.545 | 0.623 | +0.071 |
| 55 | 0.546 | 0.624 | +0.071 |
| 56 | 0.547 | 0.625 | +0.070 |
| 57 | 0.548 | 0.626 | +0.069 |
| 58 | 0.549 | 0.627 | +0.069 |
| 59 | 0.550 | 0.628 | +0.068 |
| 60 | 0.551 | 0.629 | +0.067 |
| 61 | 0.551 | 0.630 | +0.067 |
| 62 | 0.552 | 0.630 | +0.066 |
| 63 | 0.552 | 0.630 | +0.066 |
| 64 | 0.552 | 0.630 | +0.065 |
| 65 | 0.552 | 0.630 | +0.064 |
| 66 | 0.552 | 0.630 | +0.063 |
| 67 | 0.552 | 0.630 | +0.063 |
| 68 | 0.553 | 0.631 | +0.062 |
| 69 | 0.554 | 0.632 | +0.061 |
| 70 | 0.554 | 0.632 | +0.060 |
| 71 | 0.555 | 0.633 | +0.059 |
| 72 | 0.555 | 0.633 | +0.058 |
| 73 | 0.556 | 0.634 | +0.057 |
| 74 | 0.556 | 0.634 | +0.056 |
| 75 | 0.557 | 0.635 | +0.055 |
| 76 | 0.557 | 0.635 | +0.053 |
| 77 | 0.557 | 0.635 | +0.052 |
| 78 | 0.558 | 0.636 | +0.051 |
| 79 | 0.558 | 0.636 | +0.050 |
| 80 | 0.559 | 0.637 | +0.048 |
| 81 | 0.559 | 0.637 | +0.046 |
| 82 | 0.560 | 0.638 | +0.044 |
| 83 | 0.560 | 0.638 | +0.042 |

-continued

| SLOT NO. | "A" DIM | "B" DIM | "C" DIM |
|---|---|---|---|
| 84 | 0.561 | 0.639 | +0.040 |
| 85 | 0.561 | 0.639 | +0.038 |
| 86 | 0.562 | 0.640 | +0.036 |
| 87 | 0.562 | 0.640 | +0.033 |
| 88 | 0.563 | 0.641 | +0.031 |
| 89 | 0.563 | 0.641 | +0.028 |
| 90 | 0.564 | 0.642 | +0.025 |
| 91 | 0.564 | 0.642 | +0.022 |
| 92 | 0.565 | 0.643 | +0.019 |
| 93 | 0.565 | 0.643 | +0.016 |
| 94 | 0.566 | 0.644 | +0.013 |
| 95 | 0.566 | 0.644 | +0.009 |
| 96 | 0.567 | 0.645 | +0.006 |
| 97 | 0.567 | 0.645 | +0.002 |
| 98 | 0.568 | 0.646 | −0.001 |
| 99 | 0.568 | 0.646 | −0.005 |
| 100 | 0.569 | 0.647 | −0.009 |
| 101 | 0.569 | 0.647 | −0.012 |
| 102 | 0.570 | 0.648 | −0.013 |
| 103 | 0.570 | 0.648 | −0.015 |
| 104 | 0.571 | 0.649 | −0.017 |
| 105 | 0.572 | 0.650 | −0.019 |
| 106 | 0.572 | 0.650 | −0.020 |
| 107 | 0.573 | 0.651 | −0.022 |
| 108 | 0.573 | 0.651 | −0.023 |
| 109 | 0.574 | 0.652 | −0.024 |
| 110 | 0.574 | 0.652 | −0.026 |
| 111 | 0.575 | 0.653 | −0.027 |
| 112 | 0.575 | 0.653 | −0.028 |
| 113 | 0.576 | 0.654 | −0.029 |
| 114 | 0.576 | 0.654 | −0.030 |
| 115 | 0.577 | 0.655 | −0.031 |
| 116 | 0.577 | 0.655 | −0.031 |
| 117 | 0.578 | 0.656 | −0.032 |
| 118 | 0.058 | 0.656 | −0.032 |
| 119 | 0.579 | 0.657 | −0.033 |
| 120 | 0.579 | 0.657 | −0.033 |
| 121 | 0.580 | 0.658 | −0.034 |
| 122 | 0.580 | 0.658 | −0.934 |
| 123 | 0.581 | 0.659 | −0.034 |
| 124 | 0.580 | 0.659 | −0.035 |
| 125 | 0.581 | 0.659 | −0.035 |
| 126 | 0.582 | 0.660 | −0.035 |
| 127 | 0.582 | 0.660 | −0.035 |
| 128 | 0.582 | 0.660 | −0.035 |
| 129 | 0.582 | 0.660 | −0.036 |
| 130 | 0.583 | 0.661 | −0.036 |
| 131 | 0.583 | 0.661 | −0.036 |
| 132 | 0.583 | 0.661 | −0.037 |
| 133 | 0.583 | 0.661 | −0.037 |
| 134 | 0.584 | 0.662 | −0.037 |
| 135 | 0.584 | 0.662 | −0.037 |
| 136 | 0.584 | 0.662 | −0.037 |
| 137 | 0.584 | 0.662 | −0.937 |
| 138 | 0.584 | 0.662 | −0.037 |
| 139 | 0.584 | 0.662 | −0.037 |
| 140 | 0.584 | 0.662 | −0.037 |
| 141 | 0.584 | 0.662 | −0.037 |
| 142 | 0.584 | 0.662 | −0.038 |
| 143 | 0.584 | 0.662 | −0.038 |
| 144 | 0.584 | 0.662 | −0.038 |
| 145 | 0.584 | 0.662 | −0.037 |
| 146 | 0.584 | 0.662 | −0.037 |
| 147 | 0.584 | 0.662 | −0.037 |
| 148 | 0.584 | 0.662 | −0.037 |
| 149 | 0.584 | 0.662 | −0.037 |
| 150 | 0.584 | 0.662 | −0.037 |
| 151 | 0.583 | 0.661 | −0.037 |
| 152 | 0.583 | 0.661 | −0.036 |
| 153 | 0.583 | 0.661 | −0.036 |
| 154 | 0.583 | 0.661 | −0.036 |
| 155 | 0.583 | 0.661 | −0.036 |
| 156 | 0.582 | 0.660 | −0.035 |
| 157 | 0.582 | 0.660 | −0.035 |
| 158 | 0.582 | 0.660 | −0.035 |
| 159 | 0.582 | 0.660 | −0.035 |
| 160 | 0.581 | 0.659 | −0.035 |
| 161 | 0.581 | 0.659 | −0.035 |
| 162 | 0.581 | 0.659 | −0.035 |
| 163 | 0.580 | 0.658 | −0.034 |
| 164 | 0.580 | 0.658 | −0.034 |

-continued

| SLOT NO. | "A" DIM | "B" DIM | "C" DIM |
|---|---|---|---|
| 165 | 0.580 | 0.658 | −0.034 |
| 166 | 0.580 | 0.658 | −0.034 |
| 167 | 0.579 | 0.657 | −0.034 |
| 168 | 0.579 | 0.657 | −0.034 |
| 169 | 0.579 | 0.657 | −0.033 |
| 170 | 0.579 | 0.657 | −0.033 |
| 171 | 0.579 | 0.657 | −0.033 |
| 172 | 0.579 | 0.657 | −0.033 |
| 173 | 0.579 | 0.657 | −0.033 |
| 174 | 0.579 | 0.657 | −0.033 |
| 175 | 0.579 | 0.657 | −0.033 |
| 176 | 0.579 | 0.657 | −0.034 |
| 177 | 0.580 | 0.658 | −0.034 |
| 178 | 0.580 | 0.658 | −0.034 |
| 179 | 0.581 | 0.659 | −0.035 |
| 180 | 0.581 | 0.659 | −0.035 |
| 181 | 0.582 | 0.660 | −0.035 |
| 182 | 0.583 | 0.661 | −0.036 |
| 183 | 0.584 | 0.662 | −0.037 |
| 184 | 0.585 | 0.663 | −0.038 |
| 185 | 0.586 | 0.664 | −0.039 |
| 186 | 0.587 | 0.665 | −0.040 |
| 187 | 0.588 | 0.666 | −0.040 |

The SLAR antenna subject of the copending application comprises 187 waveguides, each containing radiating slots. These radiating waveguides are all excited from a single feeder or "manifold" waveguide, which is 17 feet long. Excitation of each radiating guide is via a coupling apterture in the broad wall of the manifold guide.

The very large number of radiating guides needed to obtain a sufficiently narrow antenna azimuth beam for a SLAR, were manufactured by milling from a single block of metal. The slot coupling ratios are chosed to couple out the majority (say 90% or more) of the power in the manifold guide, whilst maintaining an excitation of the radiating guides corresponding to a smoothly tapering function towards edges of the antenna.

On the basis of established design principles as outlined above and taking the parameters of the SLAR antenna as an example, this would imply slot coupling coefficients of up to about −14 dB. The maximum slot offset (or displacement of slot centre line from the centre line of the broad face of the manifold guide) would then be about 0.06".

In common with most conventional shunt displaced series feed slot devices, the signs of the slot offsets alternate along the feeder guide to permit proper phasing.

For practical reasons associated with limiting the deflection of a milling cutter when machining through a 0.4" thickness of material, the slot needs to be about 3/16" wide. It is found that there is not sufficient room for such a slot to break through within the cross-section of the radiating guide without (for one sign of offset) interfering with the attachment screw for the cover plate.

In the present coupling aperture design, a composite slot is formed, comprising two slots of differing widths in a staggered geometry. The positions of the aperture cross-section centre line relative to the centre line of the broad-face of the feeder waveguide determines the coupling. With suitable choice of parameters, the composite apertures are sufficiently close together where they break through the end-wall of the radiating guides to achieve a viable mechanical design. For example, for the SLAR antenna, the slot apertures span a total width of 0.416" at the broad face of the feeder guide, but only 0.26" at the radiating guides interface.

As cited earlier, a maximum coupling of −14 dB is needed. However the required coupling varies from aperture to aperture, being only about −31 dB at the input end of the feeder guide. In a conventional slotted waveguide series feed device, the smaller coupling ratios are realized by reducing the offset of the slots, as measured from the centre line of the broad face of the feeder waveguide. This method is satisfactory for small arrays. However, in the case of a SLAR array, if the conventional approach were adopted the slots with small coupling ratios would be displaced only about 0.008" from the centre line, which was considered to be impractical to realize, given the 17 feet length of two separately machined pieces.

A further disincentive for 0.008" offsets is that if the offset of the wide slot is made equal to this amount, the offset of the narrow slot will of course be much larger. Nominally it is the offset of the wide slot which matters. However, to the extent that asymmetrical higher order modes can penetrate the wide slot, the narrow slot is important. With the CAL Antenna geometry, the relevant order mode (TE11) has a calculated attenuation of 22 dB through the 0.15" thickness of the wide slot, which is hardly enough to permit the five times larger offset for the thin slot in the 0.008" case.

In the present coupling slot configuration, the range of slot couplings required is satisfied by varying aperture-length rather than aperture-offset. A potential problem then arises in that not only coupling but also insertion phase tends to vary. This in turn would result in a phase error associated with the excitations of the radiating guides, degrading the azimuth beam shape and increasing the level of the side lobes. By using a larger aperture offset (0.114" rather than 0.06"), even the slot with maximum coupling has a length which is shorter than the resonant length. From the theoretical treatment presented herein it can be seen that this approach reduces the insertion phase variation (maximum coupling phase—minimum coupling phase) from 80° (0.06" offset) to 30° (0.114" offset). The residual variation may now be compensated by spacing the apertures in a slightly irregular fashion along the 17 ft. length. Those near the driven end are miscentred relative to their radiating guides in such a fashion as to be further away from the source, whereas those at the load end are miscentred so as to be nearer to the source.

The embodiments of the invention in which an exclusive property or privilege is claimed are defined as follows:

1. A waveguide structure comprising:

a single primary waveguide having a longitudinal axis;

a plurality of secondary waveguides spaced from each other with respect to said primary waveguide longitudinal axis; and a composite coupling aperture for each of said secondary waveguides for providing predetermined variations in the degree of coupling between said primary waveguide and the respective secondary waveguides, each said composite coupling aperture having first and second spaced apart coupling ends separated by a thickness dimension, said first and second coupling ends having corresponding lengths and widths, the length of each of said first and second ends being greater than the corresponding width and being parallel to said primary waveguide longitudinal axis, and said predetermined variations in the degree of coupling being obtained by varying the length of at least one of said first and second aperture ends from composite coupling aperature to composite coupling aperature.

2. The waveguide structure of claim 1 wherein said first and second coupling ends of easch said composite coupling aperture have different widths.

3. The waveguide structure of claim 2 wherein said primary waveguide includes a wall having an interior surface and an exterior surface, said composite coupling apertures are formed in said primary waveguide wall with the first coupling end of each said composite coupling aperture disposed in the plane of said wall interior surface and the second coupling end of each said composite coupling aperture disposed in the plane of said wall exterior surface and opening into the corresponding secondary waveguide, the width of each said second coupling end being sufficiently less than the width of the associated first coupling end to ensure that each said second coupling end is fully within the corresponding secondary waveguide.

4. The waveguide structure of claim 3 wherein each said composite coupling aperture comprises first and second portions each having a substantially uniform cross-section along said thickness dimension, said first portion having substantially the same width as said first coupling end and said second portion having substantially the same width as said second coupling end, such that a substantially step-like transition occurs between said first and second portions.

5. The waveguide structure of claim 4 wherein said first portion is substantially thicker than said second portion.

6. The waveguide structure of claim 4 wherein at least one of said first and second portions of each of said composite coupling aperture is formed by milling in said primary waveguide wall.

7. The waveguide structure of claim 6 wherein said composite coupling aperture thickness dimension is on the order of four tenths of an inch.

8. The waveguide structure of claim 1 wherein each composite coupling aperture is transversely offset from said primary waveguide longitudinal axis by a uniform distance.

9. The waveguide structure of claim 7 wherein said uniform distance corresponds to the offset distance required to achieve the highest desired degree of coupling between said primary waveguide and a secondary waveguide.

* * * * *